United States Patent [19]

Wing et al.

[11] Patent Number: 4,809,585

[45] Date of Patent: Mar. 7, 1989

[54] EQUILIBRATOR ASSEMBLY FOR A GUN SYSTEM

[75] Inventors: Thomas Wing; Clifton T. Council, both of Woodland Hills, Calif.

[73] Assignee: Litton Systems, Inc., Woodland Hills, Calif.

[21] Appl. No.: 723,350

[22] Filed: Apr. 15, 1985

[51] Int. Cl.[4] ..... F41D 11/24

[52] U.S. Cl. ..... 89/37.08; 89/37.07

[58] Field of Search ..... 89/37.07, 37.08, 43.02, 89/40.01

[56] References Cited

U.S. PATENT DOCUMENTS

| | | | |
|---|---|---|---|
| 997,912 | 7/1911 | Haussner | 89/43.02 |
| 1,476,849 | 12/1923 | Schneider | 89/40.01 |
| 1,576,963 | 3/1926 | Froelich et al. | 89/40.01 |
| 1,577,529 | 3/1926 | Joyce | 89/37.08 |
| 1,722,862 | 7/1929 | Ricordel | 89/37.08 |
| 2,030,507 | 2/1936 | Driggs | 89/37.08 |
| 2,199,410 | 5/1940 | Lennon | 89/37.08 |
| 2,415,024 | 1/1947 | Allen | 89/37.08 |
| 2,946,262 | 7/1960 | Bruehl | 89/37.08 |
| 3,854,378 | 12/1974 | Vogel | 89/37.08 |
| 4,200,028 | 4/1980 | Bains | 89/142 |

FOREIGN PATENT DOCUMENTS

| | | | |
|---|---|---|---|
| 1296997 | 6/1969 | Fed. Rep. of Germany | 89/37.08 |
| 820994 | 8/1937 | France | 89/37.08 |
| 586981 | 4/1947 | United Kingdom | 89/37.08 |

*Primary Examiner*—Harvey E. Behrend
*Assistant Examiner*—Stephen Johnson
*Attorney, Agent, or Firm*—Poms, Smith, and Rose

[57] ABSTRACT

A gun equilibrator is shown including a driven shaft connected to the gun which compresses coned-disc springs as movement of the shaft lowers the elevated gun. The shaft is driven by a rotating drive nut that has acme threads engaging similar threads on the driven shaft. The simple design permits the compressed springs to equilibrate the gun while the acme threads absorb recoil forces.

16 Claims, 4 Drawing Sheets

EQUILIBRATOR ASSEMBLY FOR A GUN SYSTEM

The Government has rights in this invention pursuant to Contract No. DAAK11-84-C-0002 awarded by the U.S. Army Armament, Munitions, and Chemical Command. The invention described herein may be manufactured, used and licensed by or for the Government for governmental purposes without the payment to us of any royalty thereon.

FIELD OF THE INVENTION

The present invention relates to an equilibrator assembly for a gun system and, more particularly, to an equilibrator assembly utilizing coned-disc springs to counterbalance the force exerted by the mass of a cannon as it is raised and lowered upon its platform.

BACKGROUND OF THE INVENTION

It is well known in the art to utilize various arrangements for equilibrating a weapon system that includes a set of parts pivoted about a trunnion as the elevation of the weapon is adjusted. Such known arrangements rely upon pneumatic, hydraulic and spring mechanisms to achieve equilibration.

In addition to equilibration, it is desirable to stabilize the weapon as it is fired. Some of the present stabilizing arrangements use a large hydraulic cylinder whose servo control may create hydraulic pressures of several thousand pounds per square inch (psi) during equilibration. These systems, in addition to the pressure exerted to equilibrate the weight on the gun muzzle, must withstand recoiled forces of fifty thousand pounds, dissipated within less than 0.5 seconds, as the gun fires. This dynamic increase in force exerted upon the noncompressable hydraulic fluid can generate pressures up to 8,000 psi. These high pressures require the design of extremely rugged hydraulic systems in order to prevent the rupture of pipe fittings, joints and valves.

The reader's attention is directed to three patents, cited as examples of prior art systems using pneumatic, hydraulic or spring equilibrator assemblies. A pneumatic system may be found in U.S. Pat. No. 3,562,901, which issued on Feb. 16, 1971, by Joseph Ray. A hydraulic system may be found in U.S. Pat. No. 4,402,252, which issued on Sept. 6, 1983, by Walter Klumpp. Lastly, a spring system may be found in U.S. Pat. No. 4,040,332, which issued on Aug. 9, 1977, by Robert O. Border, et al.

While these systems address the problem of equilibrating the weight of a gun nozzle or countering its recoil force, each system suffers from its own limitation. The hydraulic equilibration system is subject to failure upon firing due to sharply increased hydraulic pressure. Spring and pneumatic systems suffer from design limitations. Some designs may be optimized around equilibration, while others are optimized around counterbalancing the recoil forces. It is difficult to design a system optimized to solve each problem.

It is an object of the present invention to provide a mechanical spring system capable of equilibrating a gun system and of absorbing the dynamic forces generated by its recoil.

Another object of the present invention is to provide an equilibrator assembly which may be easily designed to counterbalance the forces generated by the weight of a gun muzzle as it is elevated and depressed.

A further object of the present invention provides an equilibrator assembly which requires relatively low drive forces to adjust the assembly.

A still further object is to establish an equilibrator assembly driven by a lead screw which automatically locks the gun at any elevation, even after experiencing the dynamic forces of a firing recoil.

Yet a further object of the invention provides an equilibrator assembly for absorbing the recoil forces without transmitting those forces to the drive mechanism of the assembly.

SUMMARY OF THE INVENTION

In accomplishing these and other objects, there is provided an equilibrator assembly mounted in a generally parallel configuration with a gun system. The assembly includes a shaft subassembly linked to the trunnion of a gun barrel. The shaft subassembly further includes a lead screw at one end thereof driven by a drive nut subassembly having internal threads which mate with the lead screw. The shaft subassembly passed through a stack of coned-disc springs which are surrounded and supported by a housing. The coned-disc springs are arranged to compress as the gun barrel is lowered from an elevated position to its lowest depression. The compression of these coned-disc springs generates a force that counters the increasing weight of the gun muzzle as its center of gravity is lowered toward the horizon.

The utilization of coned-shaped springs permits a designer of an equilibrator system to closely match the force-displacement curve of the spring stack against force curve required to equilibrate the gun as it is lowered from its maximum elevation toward its minimum depression.

The simplified equilibrator assembly of the present invention permits the lead screw and its drive nut subassembly to absorb the recoil forces generated as the gun system is fired. This assembly provides a rugged stop for the dynamic recoil forces and prevents the transmission of those forces to the assembly drive mechanism. This insuring that the drive mechanism is not damaged by firing the gun system. At the same time, the simplified thread and drive nut subassembly require a reduced amount of drive force and thus a smaller prime mover.

DESCRIPTION OF THE DRAWINGS

Other objects and advantages of the present invention will be understood after careful consideration of the specification and drawings wherein.

DESCRIPTION OF THE PREFERRED EMBODIMENT

Figure 1:
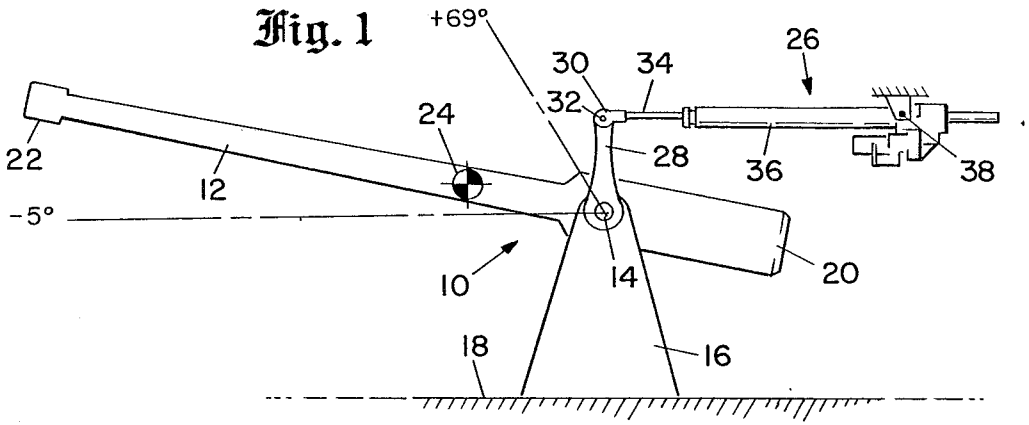
FIG. 1 is a schematic diagram showing the equilibrator assembly of the present invention used with a platform mounted gun system.

Referring now to the drawings, FIG. 1 shows schematically a gun system 10 combining a gun barrel 12 having a trunnion 14 pivotally mounted in a gun mount 16 upon a permanent platform 18. Gun barrel 12 includes a breach 20 and muzzle 22. The center of gravity 24 of the movable gun barrel is normally located toward the muzzle 22 of the barrel 12 forward of the trunnion 14. Thus, as the barrel is depressed from an elevated position, the force required to restrain the barrel at the desired elevation increases. Typically, the gun barrel 12 may be elevated to a relatively high angle, 69 degrees above the horizon in the preferred embodiment, as shown in FIG. 1, for example, or depressed to a position 5 degrees below the horizontal, for example.

The elevation and depression of a gun system 10 is generally accomplished by an equilibrator assembly 26 which may be attached to the trunnion 14 by a crank 28 connected, in turn, to an eyebolt 30 by pin 32. Attached to eyebolt 30 by suitable threads is a lead screw shaft 34 that passes through a housing 36 which is provided with its own trunnion 38 to permit the housing 36 to pivot as lead screw 34 is moved forward or backward to pivot crank 28 about the point formed by gun trunnion 14. In the preferred embodiment, the crank 28 moves 33 degrees to the right from a horizontal position and 41 degrees to the left to raise and lower the gun barrel 12 to the plus 69—minus 5 degree positions shown in FIG. 1. The details of the equilibrator assembly will be described in FIGS. 3(*a*) and (*b*) hereinbelow.

Figure 2:
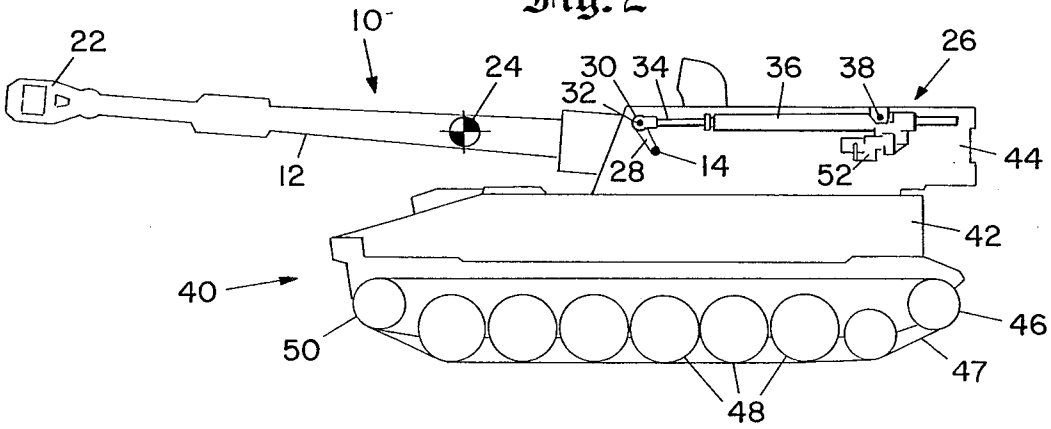
FIG. 2 is a schematic of the equilibrator assembly of the present invention mounted upon a self-propelled platform.

It will be understood that the equilibrator assembly and its gun system may be mounted in several configurations including the fixed position shown in FIG. 1 or upon a self-propelled platform such as that shown by the tank 40 in FIG. 2. Tank 40 typically includes a body 42 which mounts a revolving turret 44 into which the gun system 10 may be mounted. As is well known, the tank is propelled by a drive wheel 46 which drives a crawler track 47 over tracker rollers 48 to an idler wheel 50 from which the crawler track is returned to the drive wheel 46.

In FIG. 2, the breach 20 of gun system 10 is not shown as the equilibrator assembly 26 is offset to one side and in front of the gun barrel 12. A drive mechanism 52 mounted on the lower surface of housing 36 provides the drive force for elevating and depressing gun barrel 12. The reader will understand that the general arrangement of the equilibrator assembly 26 in FIG. 2 is similar to that shown in FIG. 1. In the preferred embodiment, the equilibrator assembly 26 is utilized to elevate a howitzer mounted upon the tank 40.

Figure 3A:
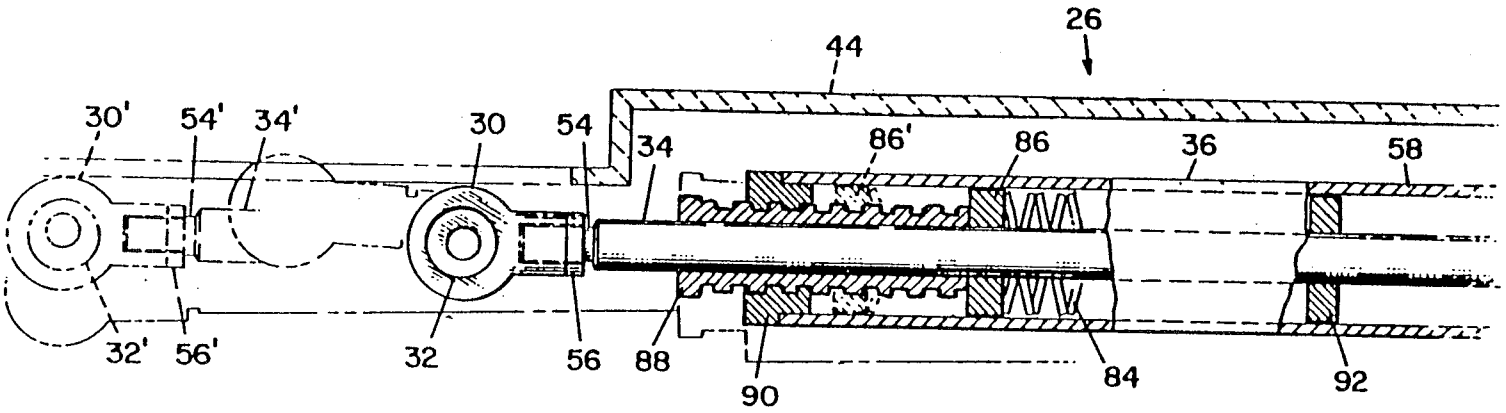
FIGS. 3(*a*) and 3(*b*) are elevational views shown partially in cross section, which may be placed end-to-end to illustrate the equilibrator assembly.
Figure 3B:
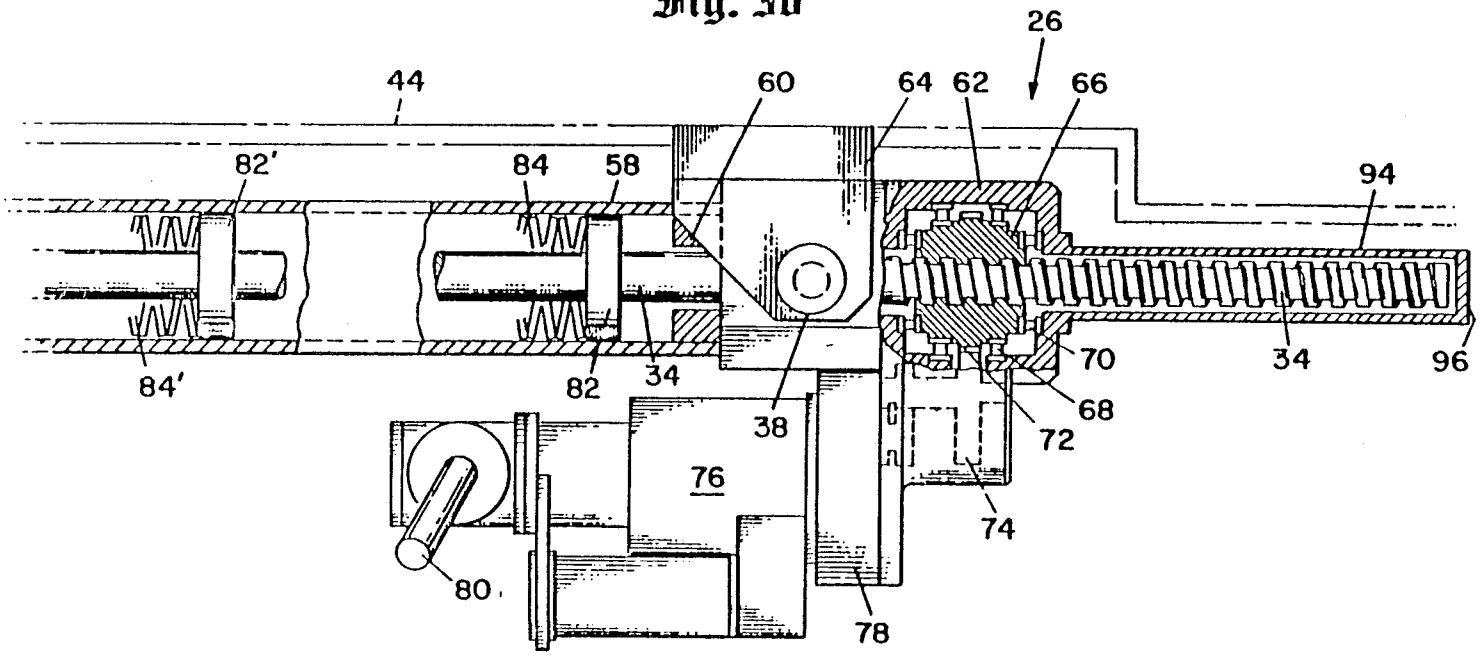

Referring now to FIGS. 3(*a*) and 3(*b*), the details of the equilibrator assembly 26 are shown when these figures are joined end-to-end. As seen in FIG. 3(*a*), the eyebolt 30 is retained on a threaded end portion 54 of lead screw shaft 34 by a lock nut 56. Lead screw 34 passes through housing 36 which consists of a cylindrical tube 58 that fits over a cylindrical boss 60, FIG. 3(*b*), which extends from the surface of a gear box housing 62. Trunnion 38 extends from the other surface of the housing 62 through a mounting bracket 64 attached to the inner surface of the tank turret 44.

Lead screw 34 passes through the cylindrical boss 60 and housing 62 to extend a substantial distance therefrom. The right-hand end of lead screw 34 is threaded with acme threads having a two inch pitch diameter or two threads per inch. The acme threads are engaged by the internal threads of a drive nut subassembly 66 rotatably mounted within housing 62 by roller bearings 68 and thrust bearings 70. The outer surface of drive nut subassembly 66 mounts a spur gear 72 driven by a suitable gear train 74 which, in turn, is driven by a prime mover 76 through a clutch 78. If desired, the equilibrator assembly may be driven by a hand crank 80 which bypasses the prime mover 76 to drive the gear train 74 directly.

It will be understood that rotation of the gear train 74 drives the spur gear 72 to rotate the drive nut subassembly 66. Such rotation causes the acme threads within the nut to displace the lead screw shaft 34 in a left-hand direction, for example, for driving a collar 82 attached to shaft 34 to the left. Collar 82 is permanently fixed to the shaft 34 to compress a plurality of coned-disc springs 84 as the shaft is driven to the left, as shown by collar 82′ and springs 84′.

Figure 4:
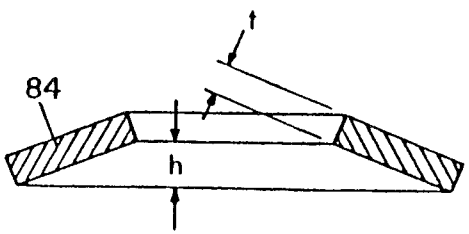
FIG. 4 is a cross sectional view of a coned-disc spring utilized within the present invention.

The coned-disc springs 84 are toroidally shaped from a generally flat piece of steel having a thickness "t" before being shaped into a cone having a height "h", see FIG. 4. The cone is formed so that the spring 84 normally rests upon its outer edge. The coned-disc springs 84, also referred to as a Belleville spring in honor of its French inventor, may be manufactured by several companies including the Rolex Company of Hillside, N.J. and the Associated Spring Corporation.

As seen in FIGS. 3(*a*) and 3(*b*), the lead screw shaft 34 passes through the internal diameter of the coned-disc springs 84 while the outer diameters thereof loosely fit within the inner diameter of the tubular housing 58. In the preferred embodiment, the coned-disc springs 84 are stacked in series between the collar 82 and a preload piston 86 slidably mounted about the lead screw shaft 34. The piston 86 is adjusted by a preload adjustment bushing 88 externally threaded and adjustably mounted within an internal thread in a closure bushing 90 that fits within the outer end of tube 58 and may be retained therein by welding, for example. Rotation of the preload adjustment bushing 88 causes the external threads to advance the bushing for moving the preload piston 86 to the right, as shown in FIG. 3(*a*) between 86′ and 86. This movement compresses and preloads the series stack of coned-disc springs 84 to equilibrate the weight of the gun system 10 in its most elevated position. The series stack of disc springs 84 may be broken by a spacer 92 which slides within the tube 56 and assures that the forces placed upon the lead screw 34 remain as compression forces and do not buckle the column formed by the lead screw.

The prime mover 76 may drive the lead screw shaft 34 to the far right-hand end of the assembly. In this configuration, shown in FIG. 3(*b*), the acme threads of shaft 34 protrude from housing 62. To protect the operator of the equilibrator assembly, a cylindrical housing 94 whose end is closed by a plate 96 is placed over the extended shaft 34. Activation of the prime mover 76 causes rotation of gear 72 for driving nut 66 which displaces shaft 34 to the left to compress the series stack of disc springs 84, as shown at 82′ and 84′. Such compression generates a counterbalancing force which equilibrates the increased load causes by the gun barrel 12 as its center of gravity 24 is lowered from its highest elevation toward its lowest depression.

Figure 5:
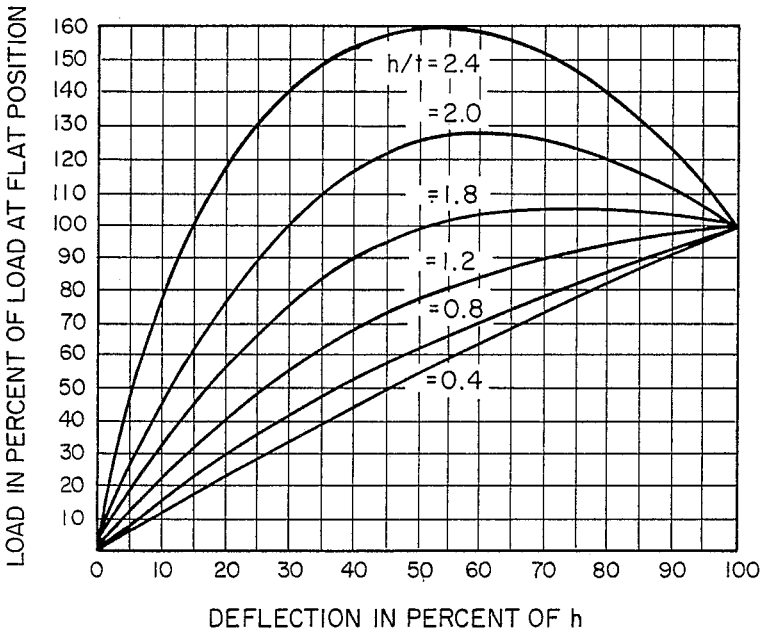
FIG. 5 is a curve showing a series of plots of load in percent of load at flat position of a coned-disc spring versus deflection in percent of height of the spring.

Use of the coned-disc springs 84 has the advantage of occupying a smaller space than coil springs. In addition, variation of the height to thickness ratio (h/t) of each disc spring produces a wide variety of load-deflection curves, as illustrated in FIG. 5. The advantage of using a stack of disc springs will be better understood by comparing the deflection curves of FIG. 5 wherein load in percent of load at flat position is plotted against deflection in percent of height. The reader will realize that a spring deflection curve, such as shown in FIG. 5, can be shaped to match a force deflection curve required to equilibrate the gun barrel 12. Thus, one first calculates a force deflection curve required for equilibrating a gun system. Once the curve is established, one may then easily design a spring stack whose curve equals or nearly equals the equilibration curve.

In the preferred embodiment, the force needed to equilibrate the gun barrel 12 and its gun system 10 is approximately 10,000 pounds at the highest elevation. This force increases to approximately 30,000 pounds at the lowest depression. It has been found that the ideal spring, FIG. 4, has an outside diameter of 5.5 inches with an inside diameter of 2.312 inches. The height of the spring is 0.225 inches, while the spring thickness is 0.275 inches. The spring material is steel. The h/t ratio is thus 0.818. These figures are given for purposes of illustration. It will be understood that other dimentions may be used within the teachings of the present invention.

The recoil force exerted by firing the gun system 10 is generally up and back along the gun barrel 12. This force is absorbed by the trunnion 14 and transmitted by the crank arm 28 to the lead screw shaft 34 where the most significant portion of the recoil force is absorbed by the external acme threads on lead screw shaft 34 and the internal threads in drive nut 66. These threads can be easily designed to withstand such loading. Thus, the drive system, which drives the drive nut 66 and lead screw 34, is protected if spur gears are used, since the recoil forces are parallel to shaft 34 and parallel to the faces of the spur gear teeth. As a consequence, no force may be transmitted to the drive system. The use of acme threads on lead screw 34 automatically locks the gun system 10 at any elevation assuming the friction angle of the threads exceeds the lead angle of the screw.

The present invention may be modified by replacing the roller bearing 68 and thrust bearings 70 with a single set of conical bearings which support the drive nut 66 in both the x and y directions. Other modifications and variations will become apparent to those skilled in the art, and the present invention should be limited only by the appended claims.

We claim:

1. An equilibrator assembly for a gun system having a barrel movable about a trunnion comprising:

a shaft connected to said trunnion by a crank for moving said barrel;

said shaft having threads at an end thereof opposite said crank;

a drive nut mounted for rotation about said threads on said shaft for moving said shaft forward and backward relative to said trunnion; and coned-disc springs mounted upon said shaft between said crank and said drive nut, said springs having a non-linear compression characteristic that counterbalances a non-linear force exerted by the weight of said gun barrel as said barrel is moved about said trunnion.

2. In an equilibrator assembly, as claimed in claim 1, wherein said coned-disc springs further includes springs having an outer and inner diameter, said inner diameter fitting over said shaft to permit the stacking of said springs upon said shaft in a series stack.

3. In an equilibrator assembly, as claimed in claim 1, additionally comprising:

said drive nut having a gear mounted upon the outer periphery thereof; and a driver including a drive gear engaging said first mentioned gear.

4. In an equilibrator assembly, as claimed in claim 3, wherein said driver further comprises a clutch, gear box and prime mover for driving said drive gear in two directions.

5. In an equilibrator assembly, as claimed in claim 3, wherein said driver further comprises a hand crank.

6. In an equilibrator assembly, as claimed in claim 1, additionally comprising:

said equilibrator assembly having a second trunnion for mounting said equilibrator assembly in a generally parallel configuration with said barrel.

7. In an equilibrator assembly, as claimed in claim 6, wherein said equilibrator assembly and said gun system are mounted within a self-propelled vehicle.

8. In an equilibrator assembly, as claimed in claim 6, wherein said equilibrator assembly and said gun system are mounted upon a fixed platform.

9. An equilibrator assembly as in claim 1, wherein said cone-disc springs have a height to thickness ratio matching a required deflection characteristic for a spring material for use in said gun, said required deflection characteristic being defined as a flattest spring deflection curve of a plurality of graphic curves, each of said curves showing the percentage of deflection of the height of a coned-disc spring as a function of percentage of load.

10. The equilibrator assembly of claim 1 wherein:

said cone-disc springs have a selected height to thickness ratio of 0.818.

11. An equilibrator assembly for a gun system having a barrel movable about a trunnion comprising:

shaft means connected to said trunnion for moving said barrel;

coned-disc spring means mounted upon said shaft means for compression as said shaft means moves said barrel to equilibrate the increased force exerted by said barrel movement;

said shaft means having threaded means thereon;

drive nut means mounted for rotation about said threaded means on said shaft means for moving said shaft means forward and backward relative to said trunnion to move said barrel, wherein said thread means and said drive nut means absorb the forces generated upon firing said gun system;

said coned-disc spring means further including a plurality of coned-disc springs each having an outer and inner diameter, said inner diameter fitting over said shaft means to permit the stacking thereof upon said shaft means in a series stack;

cylindrical housing means having first and second ends and an inner diameter sized for clearance of said outer diameter of said plurality of coned-disc spring;

internally threaded closure bushing means closing said first end of said housing means;

externally threaded pre-load bushing means mounted within said internally threaded closure bushing means having an inner diameter for slidably mounting said shaft means; and toroidally shaped pre-load piston means mounted within said housing means and about said shaft means between said pre-load bushing means and said plurality of coned-disc springs, whereby rotation of said pre-load bushing pre-loads said plurality of coned-disc springs.

12. In an equilibrator assembly, as claimed in claim 11, additionally comprising:

a toroidally shaped spacer mounted within said plurality of coned-disc springs about said shaft for slidable movement within said cylindrical housing whereby buckling of said shaft is prevented.

13. An equilibrator assembly for a gun system having a barrel movable about a trunnion comprising:

shaft means connected to said trunnion for moving said barrel;

coned-disc spring means mounted upon said shaft means for compression as said shaft means moves said barrel to equilibrate the increased force exerted by said barrel movement;

said shaft means having threaded means thereon;

drive nut means mounted for rotation about said threaded means on said shaft means for moving said shaft means forward and backward relative to said trunnion to move said barrel, wherein said thread means and said drive nut means absorb the forces generated upon firing said gun system;

said coned-disc spring means further including a plurality of coned-disc springs each having an outer and inner diameter, said inner diameter fitting over said shaft means to permit the stacking thereof upon said shaft means in a series stack;

cylindrical housing means having first and second ends and an inner diameter sized for clearance of said outer diameter of said plurality of coned-disc springs;

said drive nut means mounted in and closing said second end of said cylindrical housing means; and said shaft means having an acme thread on the outer surface thereof passing through said drive nut means.

14. An equilibrator assembly for a gun system having a barrel movable about a trunnion comprising:

shaft means connected to said trunnion for moving said barrel;

coned-disc spring means mounted upon said shaft means for compression as said shaft means moves said barrel to equilibrate the increased force exerted by said barrel movement;

said shaft means having threaded means thereon;

drive nut means mounted for rotation about said threaded means on said shaft means for moving said shaft means forward and backward relative to said trunnion to move said barrel, wherein said thread means and said drive nut means absorb the forces generated upon firing said gun system; and said drive nut means including a pair of roller bearings and a pair of thrust bearings for rotatably mounting said drive nut means within said equilibrator assembly.

15. An equilibrator assembly for a gun system having a barrel movable about a trunnion comprising:

shaft means connected to said trunnion for moving said barrel;

coned-disc spring means mounted upon said shaft means for compression as said shaft means moves said barrel to equilibrate the increased force exerted by said barrel movement;

said shaft means having threaded means thereon;

drive nut means mounted for rotation about said threaded means on said shaft means for moving said shaft means forward and backward relative to said trunnion to move said barrel, wherein said thread means and said drive nut means absorb the forces generated upon firing said gun system; and said drive nut means including a pair of conical bearings rotatably mounting said drive nut means within said equilibrator assembly.

16. In an equilibrator assembly for a gun system having a barrel pivoted about a trunnion and the center of mass of said barrel located beyond said trunnion which increases, non-linearly the force needed to equilibrate said barrel as said barrel is lowered from an elevated position, the improvement comprising:

a shaft connected to said trunnion for lowering and elevating said barrel;

said shaft having threads thereon;

a drive nut mounted for rotation about said threads on said shaft for moving said shaft forward and backward relative to said trunnion to lower and elevate said barrel; and a plurality of coned-disc springs mounted upon said shaft for compression as said shaft lowers said barrel, said springs having a non-linear compression characteristic that counterbalances and equilibrates said non-linear force created as said barrel is lowered from an elevated position.

* * * * *